US010718254B2

(12) United States Patent
Jones

(10) Patent No.: US 10,718,254 B2
(45) Date of Patent: Jul. 21, 2020

(54) COOLANT APPARATUS

(71) Applicant: JAGUAR LAND ROVER LIMITED, Warwickshire (GB)

(72) Inventor: Steve Jones, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 16/311,183

(22) PCT Filed: May 17, 2017

(86) PCT No.: PCT/EP2017/061890
§ 371 (c)(1),
(2) Date: Dec. 19, 2018

(87) PCT Pub. No.: WO2017/220264
PCT Pub. Date: Dec. 28, 2017

(65) Prior Publication Data

US 2019/0264598 A1 Aug. 29, 2019

(30) Foreign Application Priority Data

Jun. 24, 2016 (GB) ..... 1611024.9

(51) Int. Cl.
*F01P 3/02* (2006.01)
*F02F 1/40* (2006.01)

(52) U.S. Cl.
CPC *F01P 3/02* (2013.01); *F02F 1/40* (2013.01); *F01P 2003/024* (2013.01)

(58) Field of Classification Search
CPC ..... F01P 3/02; F01P 7/14; F01P 11/04; F01P 2003/024; F02F 1/10; F02F 1/24; F02F 1/36; F02F 1/40
See application file for complete search history.

(56) References Cited

U.S. PATENT DOCUMENTS 2,405,847 A * 8/1946 Pullin ..... F02F 11/005 123/41.81
3,165,095 A 1/1965 Adler
(Continued)

FOREIGN PATENT DOCUMENTS

DE 938159 C 1/1956
DE 10 2006 022413 A1 11/2007
(Continued)

OTHER PUBLICATIONS

Combined Search and Examination Report under Sections 17 and 18(3) for Application No. GB1611024.9 dated Jan. 16, 2017.
(Continued)

*Primary Examiner* — Grant Moubry
(74) *Attorney, Agent, or Firm* — Carlson, Gaskey & Olds

(57) ABSTRACT

The present disclosure relates to a coolant circuit (1) for a multi-cylinder internal combustion engine (3). The coolant circuit (1) having a plurality of coolant passages (10-1, 10-2, 10-3). A coolant distribution chamber (11) is provided in the coolant circuit (1). The coolant distribution chamber (11) has opposing first and second walls (12, 13) and a sidewall (14) extending between said first and second walls (12, 13). A coolant inlet (15) is disposed in the first wall (12) and a plurality of coolant outlets (17-1, 17-2, 17-3) are disposed in the sidewall (14). The coolant outlets (17-1, 17-2, 17-3) are each connected to a respective one of said coolant passages (10-1, 10-2, 10-3). A guide (18) is disposed in the coolant distribution chamber (11) for guiding coolant introduced into the coolant distribution chamber (11) through the coolant inlet (15) outwardly towards said coolant outlets (17-1, 17-2, 17-3). The coolant distribution chamber (11) may comprise a toroidal chamber. The present disclosure also relates to an internal combustion engine (3) and a cylinder
(Continued)

head (2) comprising a coolant circuit (1). The present disclosure also relates to a vehicle (4).

20 Claims, 4 Drawing Sheets

(56) References Cited

U.S. PATENT DOCUMENTS

| | | | | |
|---|---|---|---|---|
| 6,981,473 | B2 * | 1/2006 | Gunji | F02B 61/02 123/193.5 |
| 8,960,137 | B2 * | 2/2015 | Brewer | F02F 1/24 123/41.82 R |
| 9,840,961 | B2 * | 12/2017 | Craft | F01P 3/02 |
| 10,107,171 | B2 * | 10/2018 | Ogino | F01P 3/02 |
| 10,240,511 | B2 * | 3/2019 | Clark | F01P 3/02 |
| 2014/0069357 | A1 * | 3/2014 | Brewer | F01N 13/105 123/41.82 R |
| 2016/0025033 | A1 | 1/2016 | Ortmann | |
| 2016/0273481 | A1 * | 9/2016 | Ickinger | F02F 1/38 |
| 2016/0377023 | A1 * | 12/2016 | Suh | F02F 1/14 123/41.79 |
| 2017/0022880 | A1 * | 1/2017 | Seeger | F01P 3/02 |

FOREIGN PATENT DOCUMENTS

| | | | |
|---|---|---|---|
| DE | 20 2006 020280 | U1 | 2/2008 |
| DE | 10 2007 048021 | A1 | 4/2009 |
| DE | 10 2009 021471 | A1 | 12/2010 |
| DE | 10 2014 207202 | A1 | 10/2015 |
| EP | 1239135 | A2 | 9/2002 |
| FR | 2800125 | A1 | 4/2001 |
| GB | 740117 | A | 11/1955 |

OTHER PUBLICATIONS

International Search Report and Written Opinion of the International Searching Authority for International application No. PCT/EP2017/061890 dated Aug. 9, 2017.

* cited by examiner

COOLANT APPARATUS

TECHNICAL FIELD

The present disclosure relates to a coolant apparatus. In particular, but not exclusively, the present disclosure relates to a coolant circuit for an internal combustion engine; to an internal combustion engine incorporating a coolant circuit; and to a cylinder head incorporating a coolant circuit. The present disclosure also relates to a vehicle.

BACKGROUND

An internal combustion engine comprises a cylinder head and a cylinder block which form one or more combustion chamber. In a multi-cylinder combustion engine it is desirable for the combustion events in all of the cylinders to be homogenous. An important factor for achieving uniform combustion events is to maintain the same wall temperature for all of the combustion chambers. This requires consistent cooling of each cylinder within the internal combustion engine. A coolant circuit comprising a plurality of coolant passages is normally provided in the cylinder head. The coolant circuit is configured to supply a continuous, controlled flow of a liquid coolant, typically a water-based coolant, through the coolant passages. The coolant passages are arranged proximal to the combustion chambers to extract the thermal energy conducted through the chamber walls. A single coolant pump is typically provided to circulate the coolant through the coolant passages. The flow from the coolant pump is divided into several flow streams and supplied to each cylinder coolant jacket. Dividing a single flow stream into multiple flow streams having the same mass flow rate can be problematic. In general terms, when a single inlet passage is split into multiple passages, the direction of the bulk fluid flow from the inlet passage causes a flow bias in those passages more closely aligned with the inlet flow. To reduce or minimise this flow bias may require considerable design work to achieve an acceptable solution across the complete operating range of the engine. This may result in restricted flow causing pressure flow losses that result in excessive pump power expenditure and excessive fuel usage.

It is against this backdrop that the present invention has been conceived. At least in certain embodiments, the present invention seeks to overcome or ameliorate at least some of the problems associated with prior art coolant circuits.

SUMMARY OF THE INVENTION

Aspects of the present invention relate to a coolant circuit for an internal combustion engine; to an internal combustion engine comprising a coolant circuit; to a cylinder head comprising a coolant circuit; and to a vehicle as claimed in the appended claims.

According to an aspect of the present invention there is provided a coolant circuit for a multi-cylinder internal combustion engine, the coolant circuit comprising:

a plurality of coolant passages;

a coolant distribution chamber having opposing first and second walls and a sidewall extending between said first and second walls, wherein a coolant inlet is disposed in said first wall and a plurality of coolant outlets are disposed in said sidewall, each of said coolant outlets being connected to a respective one of said coolant passages; and a guide being disposed in the coolant distribution chamber for guiding coolant introduced into the coolant distribution chamber through the coolant inlet outwardly towards said coolant outlets. The coolant circuit may be configured to establish substantially equal mass flow rates through the coolant passages. The proportion of the coolant supplied to the coolant passages may be independent of variations in an inlet mass flow rate and/or pressure.

The guide may be disposed opposite the coolant inlet. The guide may comprise a curved lateral section for directing coolant introduced through said coolant inlet in a radially outward direction.

The coolant distribution chamber may comprise a central longitudinal axis. The coolant distribution chamber may be circular in a transverse section perpendicular to the central longitudinal axis of the coolant distribution chamber.

The coolant inlet and the guide may be aligned with each other. The coolant inlet and the guide may be aligned with the central longitudinal axis of the coolant distribution chamber.

The coolant inlet and the guide may be arranged substantially co-axially with said central longitudinal axis. The coolant inlet may be circular.

The guide may be formed in said second wall. The guide may comprise a projection extending from said second wall. The projection may have a tapered sidewall. In certain embodiments, the projection may be conical. The guide may be formed integrally with said second wall.

The coolant distribution chamber may consist of the coolant inlet disposed in said first wall and said coolant outlets disposed in said sidewall. The coolant inlet and the coolant outlets may be arranged substantially perpendicular to each other.

The coolant inlet may be disposed centrally in said first wall. The guide may be disposed centrally in said second wall.

The coolant inlet may be connected to a coolant supply passage. The coolant supply passage may be configured to introduce coolant into the coolant distribution chamber along a central longitudinal axis of the coolant distribution chamber. A single coolant supply passage may be provided. The coolant supply passage may be connected to a coolant pump.

The coolant distribution chamber may comprise an annular chamber. The coolant distribution chamber may comprise a toroidal chamber.

The sidewall of the coolant distribution chamber may be annular. The sidewall may have a substantially circular profile in a transverse section perpendicular to a central longitudinal axis of the coolant distribution chamber. The sidewall may have a curved profile in a longitudinal section coincident with the central longitudinal axis of the coolant distribution chamber. The radius of the sidewall in said longitudinal section may be greater than, equal to, or less than the radius of the sidewall in said transverse section.

The coolant passages may extend laterally from the sidewall of said coolant distribution chamber. The coolant passages may extend substantially radially outwardly from said coolant distribution chamber. The coolant outlets may be radially offset from each other in the sidewall of the coolant distribution chamber.

According to a further aspect of the present invention there is provided an internal combustion engine comprising a coolant circuit as described herein. The internal combustion engine may be a multi-cylinder internal combustion engine. Each of said coolant passages may be associated with one or more cylinder of said internal combustion engine. The internal combustion engine may comprise a cylinder head. The coolant circuit may be integrated into said cylinder head. The cylinder head may be mounted to a cylinder block.

The coolant circuit may be formed in the cylinder head and/or in the cylinder block. The coolant distribution chamber may be formed in the cylinder head or the cylinder block. In a further alternative, the coolant distribution chamber may be formed between said cylinder head and the cylinder block. The coolant passages may be formed in said cylinder head and/or said cylinder block.

According to a further aspect of the present invention there is provided a cylinder head comprising a coolant circuit described herein. The coolant circuit may be integrated into said cylinder head. For example, the coolant distribution chamber may be formed integrally with said cylinder head.

According to a further aspect of the present invention there is provided a cylinder head comprising a coolant circuit as described herein. At least some of the coolant circuit may be integrated into said cylinder head. The coolant distribution chamber may, for example, be formed in the cylinder head. A coolant supply passage may be connected to the coolant inlet. The coolant supply passage may be connected to a coolant pump.

The coolant passages may each be associated with one or more cylinder of said internal combustion engine. In curtain embodiments, the coolant passages may each be associated with more than one of the cylinders of said internal combustion engine. The coolant passages may, for example, comprise an annular section extending around said cylinder.

According to a further aspect of the present invention there is provided an internal combustion engine comprising a cylinder head as described herein.

According to a further aspect of the present invention there is provided a vehicle comprising an internal combustion engine as described herein.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present invention will now be described, by way of example only, with reference to the accompanying figures, in which.

DETAILED DESCRIPTION

A coolant circuit 1 for distributing liquid coolant within a cylinder head 2 of an internal combustion engine 3 in accordance with an embodiment of the present invention will now be described with reference to the accompanying figures.

Figure 1:
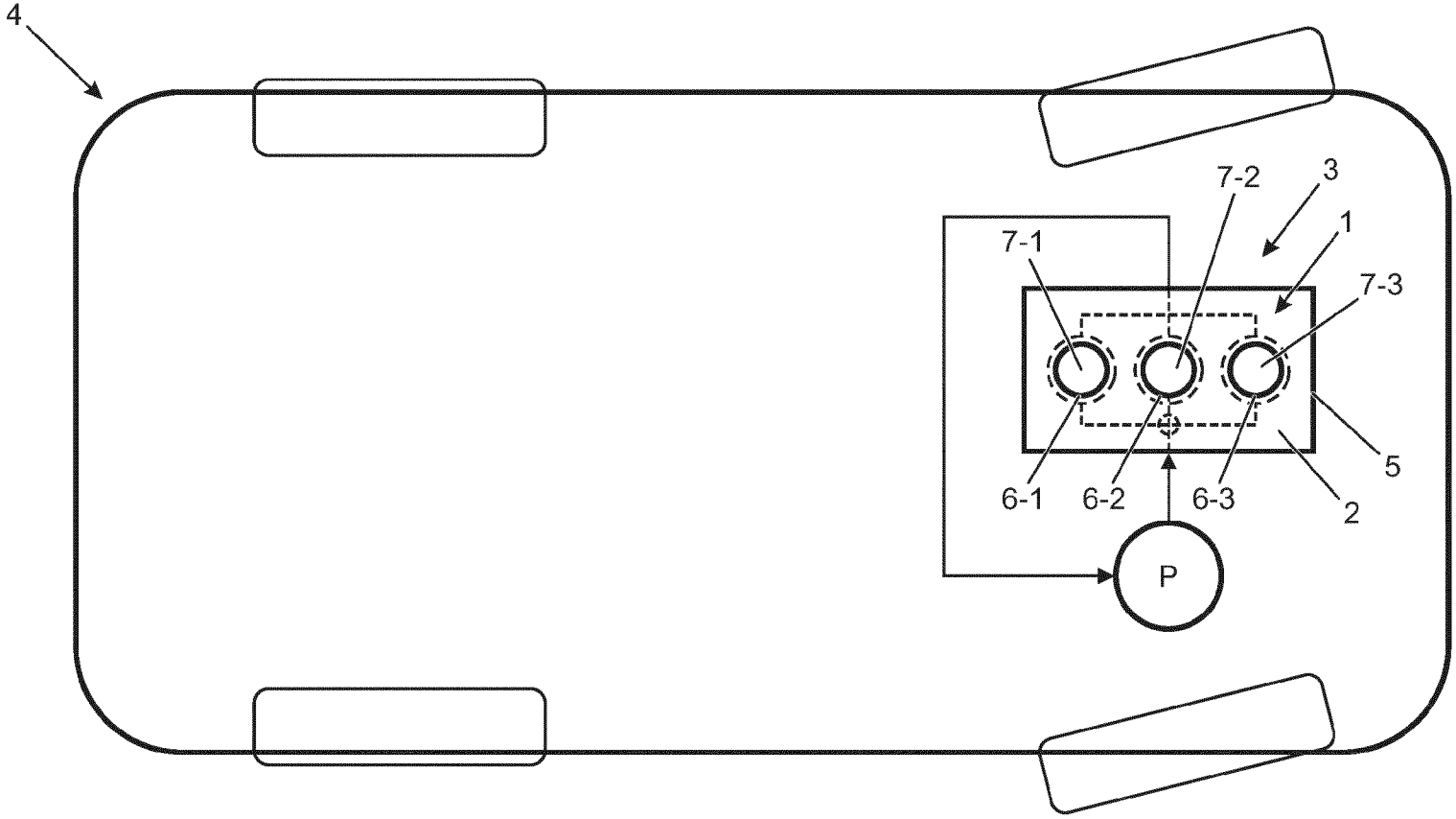
FIG. 1 shows a schematic representation of a vehicle incorporating an internal combustion engine having a coolant circuit in accordance with an embodiment of the present invention.

As shown on FIG. 1, the internal combustion engine 3 is installed in a vehicle 4, such as an automobile. The internal combustion engine 3 in the present embodiment is an in-line three (3) cylinder engine. The cylinder head 2 is mounted to a cylinder block 5 comprising first, second and third cylinders 6-1, 6-2, 6-3 in which pistons (not shown) reciprocate. The cylinder head 2 is mounted to the cylinder block 5 to form first, second and third combustion chambers 7-1, 7-2, 7-3. A plurality of injection ports 8 and exhaust ports 9 are disposed in the cylinder head 2 for injecting fuel into the combustion chambers 7-1, 7-2, 7-3 and expelling exhaust gas. The internal combustion engine 3 in the present embodiment is a spark ignition combustion engine, for example a gasoline engine. However, the present invention could also be implemented in a compression ignition combustion engine, for example a diesel engine.

The coolant circuit 1 is integrated into the cylinder head water jacket and circulates liquid coolant through the cylinder head 2. The coolant is pumped through a heat exchanger (not shown) to reject heat, for example to the ambient surroundings. The cylinder head 2 has a unitary structure, for example formed from a one-piece iron or aluminium casting. As described herein, the coolant circuit 1 is integrated into the cylinder head 2 and is formed when the cylinder head 2 is cast.

Figure 2:
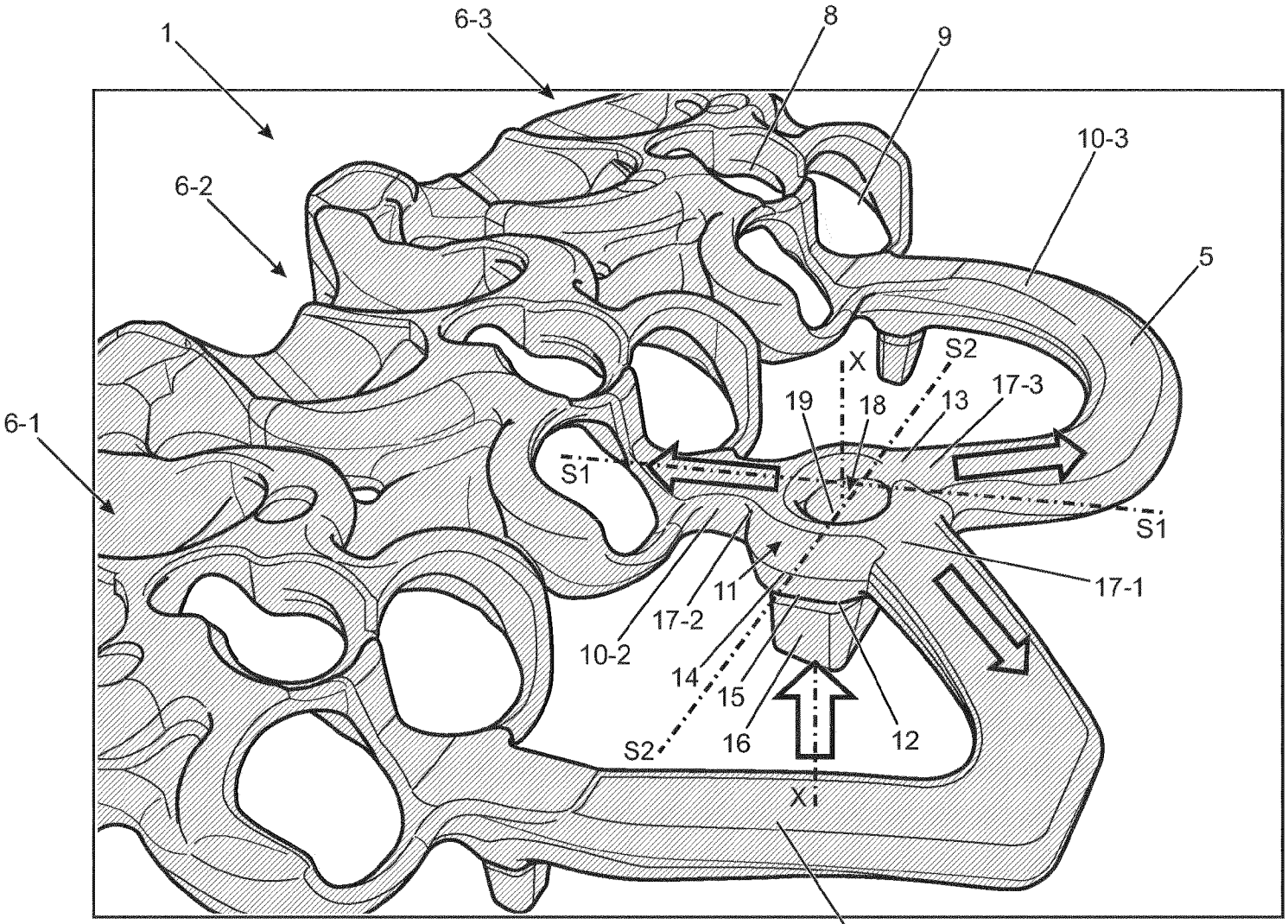
FIG. 2 shows a perspective view of the coolant circuit integrated into the cylinder head of the internal combustion engine shown in FIG. 1.

A perspective view of the configuration of the coolant circuit 1 is shown in FIG. 2. With reference to FIG. 2, the coolant circuit 1 comprises first, second and third coolant passages 10-1, 10-2, 10-3 associated with the first, second and third combustion chambers 7-1, 7-2, 7-3 respectively. The first, second and third coolant passages 10-1, 10-2, 10-3 are connected to a coolant distribution chamber 11. The coolant distribution chamber 11 has a central longitudinal axis X-X which extends substantially vertically in the present embodiment. The coolant distribution chamber 11 comprises a first wall 12, a second wall 13 and a sidewall 14. The first wall 12 is disposed at the bottom of the coolant distribution chamber 11; and the second wall 13 is disposed at the top of the coolant distribution chamber 11. The sidewall 14 extends between said first and second walls 12, 13 and has a curved profile in both longitudinal and horizontal sections. The sidewall 14 has a circular profile in a horizontal section perpendicular to the central longitudinal axis X-X; and a curved profile in a longitudinal section coincident with the central longitudinal axis X-X of the coolant distribution chamber 11.

A coolant inlet 15 is formed in the first wall 12 at the bottom of the coolant distribution chamber 11. A coolant supply passage 16 connects to the coolant inlet 15 to supply coolant to the coolant distribution chamber 11. The coolant supply passage 16 is connected to a coolant pump P operative to circulate coolant. The coolant inlet 15 is centred on the central longitudinal axis X-X of the coolant distribution chamber 11. Moreover, proximal to the coolant distribution chamber 11, a longitudinal axis of the coolant supply passage 16 is arranged co-axially with said central longitudinal axis X-X such that, in use, the coolant entering the coolant distribution chamber 11 has a flow direction substantially parallel to said central longitudinal axis X-X. A plurality of coolant outlets 17 are formed in the sidewall 14 of the coolant distribution chamber 11. The coolant outlets 17 are disposed at different radial positions around the perimeter of the coolant distribution chamber 11. The coolant outlets 17 are connected to the coolant passages 10. In the present embodiment, the coolant circuit 1 comprises first, second and third coolant outlets 17-1, 17-2, 17-3 which are connected to the first, second and third coolant passages 10-1, 10-2, 10-3 respectively. The first, second and third coolant outlets 17-1, 17-2, 17-3 extend radially outwardly from the central longitudinal axis X-X of the coolant distribution chamber 11. Thus, the first, second and third coolant passages 10-1, 10-2, 10-3 are substantially orthogonal to the coolant inlet 15.

Figure 3:
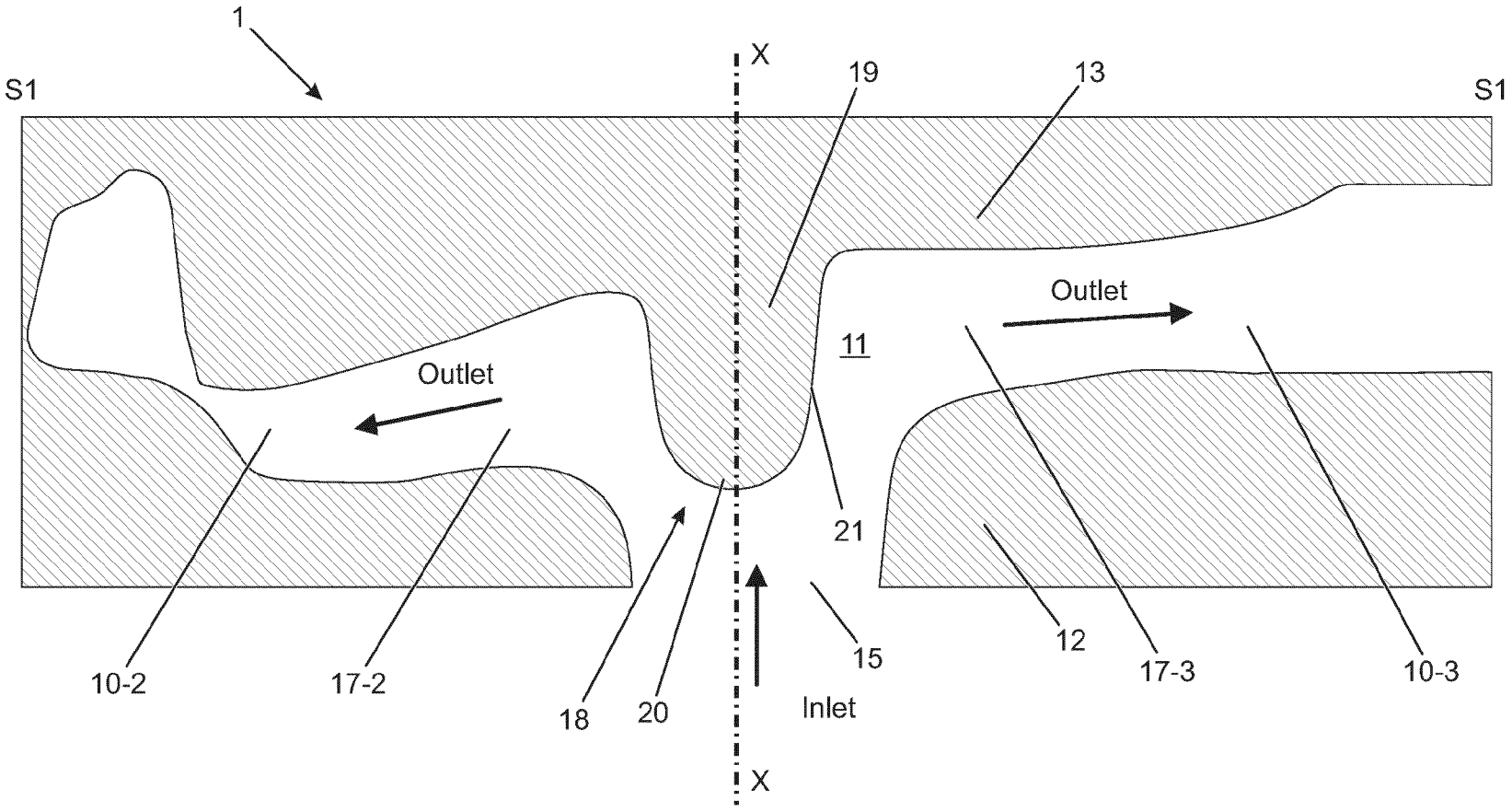
FIG. 3 shows a first section through the coolant circuit shown in FIG. 2.
Figure 4:
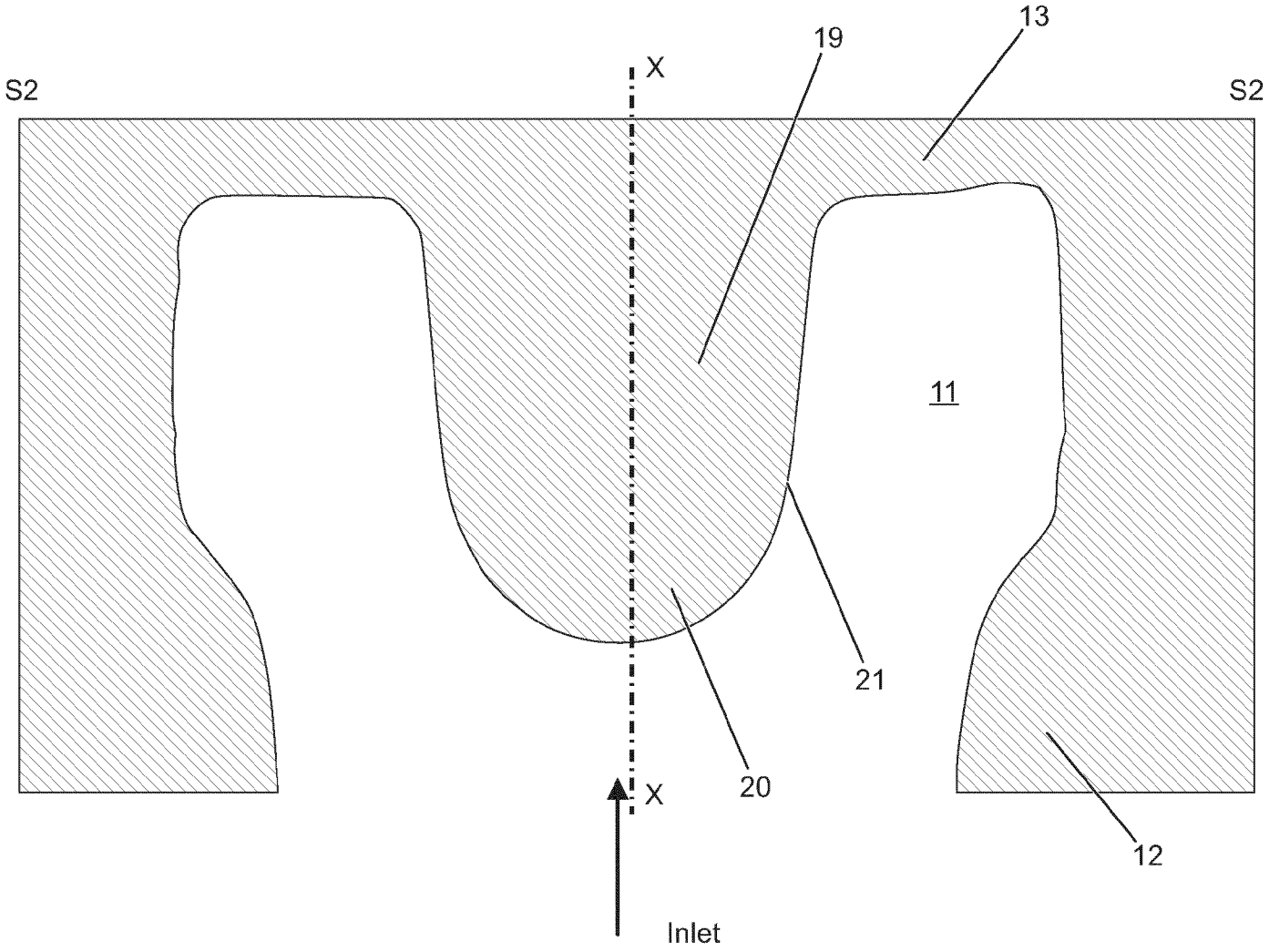
FIG. 4 shows a second section through the coolant circuit shown in FIG. 2.

A first section along section line S1 is shown in FIG. 3; and a second section along section line S2 is shown in FIG. 4. As shown most clearly in FIGS. 3 and 4, the second wall 13 comprises a guide 18 for guiding the flow of coolant radially outwardly. The guide 18 is disposed opposite the coolant inlet 15. The guide 18 extends into the coolant distribution chamber 11 such that the coolant distribution chamber 11 comprises a toroidal chamber in which the coolant may circulate, as shown in FIG. 4. In the present embodiment, the guide 18 is formed integrally with the second wall 13. The guide 18 comprises a projection 19 having a rounded end portion 20 for guiding the coolant as it is introduced into the coolant distribution chamber 11 from the coolant inlet 15. The projection 19 has a sidewall 21 that is tapered outwardly away from the coolant inlet 15. Thus, the projection 19 in the present embodiment is generally conical in shape. In use, the tapered sidewall 21 of the projection 19 may help to guide the coolant radially outwardly towards the first, second and third outlets 17-1, 17-2, 17-3. The projection 19 is arranged substantially co-axially with the central longitudinal axis X-X of the coolant distribution chamber 11. In alternate embodiments, the projection 19 may have a substantially uniform section, for example in the form of a cylinder.

The operation of the coolant circuit 1 will now be described with reference to the accompanying figures. The internal combustion engine 3 operates in a conventional manner and will not be described in detail herein. When the internal combustion engine 3 is running, the pump is activated to circulate liquid coolant through the coolant circuit 1. The operating speed of the pump may be constant or may be controllably adjusted, for example in dependence on one or more temperature signal. The coolant is pumped through the coolant supply passage 16 and enters the coolant distribution chamber 11 through the coolant inlet 15. Upon entry into the coolant distribution chamber 11, the coolant has a flow direction which is substantially coincident with the central longitudinal axis X-X of the coolant distribution chamber 11. The guide 18 is disposed opposite the coolant inlet 15 and is operative to deflect the coolant flow outwardly. In particular, the tapered sidewall 21 guides the flow outwardly along the second wall 13 forming the top of the coolant distribution chamber 11. The re-directed coolant flows radially outwardly towards the sidewall 14 of the coolant distribution chamber 11. Some of the coolant exits the coolant distribution chamber 11 through one of the first, second and third coolant outlets 17-1, 17-2, 17-3 and enters the first, second and third coolant passages 10-1, 10-2, 10-3. The coolant which does not exit through one of the first, second and third coolant outlets 17-1, 17-2, 17-3 circulates within the coolant distribution chamber 11, the curved profile of the sidewall 14 directing the flow downwardly and then back towards the central longitudinal axis X-X as it approaches the first wall 12. The coolant may thereby adopt a toroidal flow pattern/stream within the coolant distribution chamber 11. The first wall 12 may be profiled to promote this flow pattern as the coolant travels radially inwardly towards the central longitudinal axis X-X. For example, an annular guide may be formed in the first wall 12 around the coolant inlet 15.

At least in certain embodiments the first, second and third coolant passages 10-1, 10-2, 10-3 can be tuned such that the mass flow rate of the coolant in each of the first, second and third coolant passages 10-1, 10-2, 10-3 is substantially the same. Furthermore, the mass flow rate in each of the first, second and third coolant passages 10-1, 10-2, 10-3 is directly proportional to the mass flow rate of the coolant through the coolant inlet 15. Thus, the circulation of coolant within the coolant circuit 1 can be readily controlled in dependence on operation of the pump.

Prior art systems may require tuning to optimise mass flow rates through multiple conduits, for example to optimise the flow at a specific mass flow rate or over a small range of mass flow rates. Moreover, prior art systems may be affected by the direction of the flow proximal to a junction. At least in certain embodiments, the coolant circuit 1 described herein may overcome or ameliorate some of the aforementioned problems. The mass flow rate through each of the first, second and third coolant passages 10-1, 10-2, 10-3 is substantially the same. The mass flow rate to each of the first, second and third coolant passages 10-1, 10-2, 10-3 is a fixed proportion of the mass flow rate to the coolant inlet 12 from the coolant pump P. Moreover, the coolant circuit 1 may more readily be configured to maintain proportional mass flow rates over a range of operating conditions. The configuration of the coolant distribution chamber 11 is such that the mass flow rate to the first, second and third coolant passages 10-1, 10-2, 10-3 can more readily be optimised for different operating conditions. The proportion of the coolant supplied to each of the first, second and third coolant passages 10-1, 10-2, 10-3 is relatively independent of changing inlet mass flow rates and pressures.

The central longitudinal axis X-X of the coolant distribution chamber 11 has been described herein as being vertical. Other orientations of the central longitudinal axis X-X are also useful. For example, the coolant distribution chamber 11 may be configured such that the central longitudinal axis X-X is inclined at an acute angle to the vertical, or is disposed horizontally. The position and/or orientation of the coolant inlet 15 and the coolant outlets 17 may be adjusted to maintain the flow pattern of the coolant within the coolant distribution chamber 11.

The present invention has been described with reference to an in-line three (3) cylinder internal combustion engine 3. It will be appreciated that the present invention may be implemented in an internal combustion engine 3 having two (2) cylinders or more than three (3) cylinders. Moreover, the present invention is not limited to internal combustion engines having in-line cylinders.

It will be appreciated that various changes and modifications can be made to the apparatus described herein without departing from the scope of the present invention.

The invention claimed is:

1. A cylinder head comprising a coolant circuit, the coolant circuit comprising:

a plurality of coolant passages;

a coolant distribution chamber having opposing first and second walls and a sidewall extending between said first and second walls, wherein the coolant distribution chamber comprises a toroidal chamber;

a coolant inlet disposed in said first wall;

a plurality of coolant outlets disposed in said sidewall, each of said coolant outlets being connected to a respective one of said coolant passages; and a guide disposed in the coolant distribution chamber for guiding coolant introduced into the coolant distribution chamber through the coolant inlet outwardly toward said coolant outlets.

2. A cylinder head as claimed in claim 1, wherein the guide is disposed opposite the coolant inlet.

3. A cylinder head as claimed in claim 1, wherein the guide comprises a curved lateral section for directing coolant introduced through said coolant inlet in a radially outward direction.

4. A cylinder head as claimed in claim 1, wherein the coolant inlet and the guide are aligned with each other.

5. A cylinder head as claimed in claim 1, wherein the guide is formed in said second wall.

6. A cylinder head as claimed in claim 5, wherein the guide comprises a projection extending from said second wall.

7. A cylinder head as claimed in claim 1, wherein the coolant inlet and the coolant outlets are arranged substantially perpendicular to each other.

8. A cylinder head as claimed in claim 1, wherein the coolant inlet is disposed centrally in said first wall.

9. A cylinder head as claimed in claim 8, wherein the guide is disposed centrally in said second wall.

10. A cylinder head as claimed in claim 1, comprising a coolant supply passage connected to the coolant inlet.

11. A cylinder head as claimed in claim 1, wherein the sidewall has a substantially circular profile in a transverse section perpendicular to a central longitudinal axis of the coolant distribution chamber.

12. A cylinder head as claimed in claim 1, wherein said coolant passages extend laterally from said coolant distribution chamber.

13. An internal combustion engine comprising a cylinder head as claimed in claim 1.

14. An internal combustion engine as claimed in claim 13, wherein said coolant passages are respectively associated with at least one cylinder of said internal combustion engine.

15. A vehicle comprising an internal combustion engine as claimed in claim 13.

16. A cylinder head as claimed in claim 1, wherein said coolant passages extend laterally from said coolant distribution chamber.

17. A cylinder head as claimed in claim 1, wherein the coolant inlet is disposed centrally in said first wall.

18. A cylinder head as claimed in claim 17, wherein the guide is disposed centrally in said second wall.

19. A cylinder head as claimed in claim 1, wherein the sidewall has a curved profile in a longitudinal section coincident with a central longitudinal axis of the coolant distribution chamber.

20. A cylinder head as claimed in claim 19, wherein the guide is disposed in the coolant distribution chamber opposite the coolant inlet for guiding coolant introduced into the coolant distribution chamber through the coolant inlet outwardly toward said coolant outlets and around the curved profile of the sidewall in a toroidal flow pattern.

* * * * *